US005943909A

United States Patent [19]

Soh

[11] Patent Number: 5,943,909

[45] Date of Patent: Aug. 31, 1999

[54] STARTER FOR ENGINE HAVING WATER DRAINAGE HOLE

[75] Inventor: Masahiro Soh, Anjo, Japan

[73] Assignee: Denso Corporation, Kariya, Japan

[21] Appl. No.: 09/004,609

[22] Filed: Jan. 8, 1998

[30] Foreign Application Priority Data

Jan. 9, 1997 [JP] Japan ..... 9-001787
Nov. 17, 1997 [JP] Japan ..... 9-314926

[51] Int. Cl.[6] ..... F02N 11/00

[52] U.S. Cl. ..... 74/6; 74/7 R; 123/179.25

[58] Field of Search ..... 74/6, 7 R; 180/287, 180/65.2, 165; 310/83; 290/48, 38 R; 123/179.25

[56] References Cited

U.S. PATENT DOCUMENTS 5,010,265 4/1991 Tanaka et al. ..... 310/88
5,053,633 10/1991 Sugiyama et al. ..... 290/48
5,307,700 5/1994 Spellman et al. ..... 74/7 A
5,625,242 4/1997 Shiga ..... 310/198
5,844,336 12/1998 Ohya et al. ..... 310/80
5,847,471 12/1998 Morishita et al. ..... 290/48

FOREIGN PATENT DOCUMENTS 8-61196 3/1996 Japan .

*Primary Examiner*—John A. Jeffery
*Assistant Examiner*—David Fenstermacher
*Attorney, Agent, or Firm*—Pillsbury Madison & Sutro LLP

[57] ABSTRACT

A labyrinth drainage construction for draining water which has penetrated into a front case of a starter is provided by a groove, a communication port, and a drainage hole. The groove is formed on a lower inner peripheral surface of a fit-in portion of the front case which fits with a center case such that the groove extends backward along the lower part of a holding plate from the front side of the holding plate. The communication port is interposed between the groove and a rotation restriction member-holding space located between the holding plate and the center case, thus communicating the groove and the rotation restriction member-holding space with each other. A drainage hole is positioned axially rearward from the communication port and communicates the groove and the outside of the front case.

8 Claims, 3 Drawing Sheets

STARTER FOR ENGINE HAVING WATER DRAINAGE HOLE

CROSS REFERENCE TO RELATED APPLICATION

This application relates to and incorporates herein by reference Japanese patent applications No. 9-1787 filed on Jan. 9, 1997 and No. 9-314926 filed on Nov. 17, 1997.

BACKGROUND OF THE INVENTION

1. Field of the Invention

The present invention relates to a starter for starting an engine and, more particularly to a starter having a water drainage hole.

2. Description of Related Art:

In one type of a conventional starter such as disclosed in Japanese Laid-open Patent Publication No. 8-61196, the starter comprises a pinion gear, a helical spline of which mates the helical spline formed on the periphery of an output shaft, and a rotation restriction member restricting the rotation of the pinion gear. In order to engage the pinion gear with the ring gear of an engine, when the armature is rotated, the rotation restriction member is operated by the attraction force of an electromagnetic switch to restrict the rotation of the pinion gear and move the pinion gear axially by a thrust generated on the helical spline.

This starter allows the attraction force of the electromagnetic switch to be smaller than that of the other type of starter which engages the pinion gear with the ring gear by pressing the pinion gear axially to the ring gear by the attraction force of the electromagnetic switch. Thus, the starter according to the patent publication is effective for reducing the size of the electromagnetic switch in size, thus allowing the electromagnetic switch to be positioned at the rear of a starting motor. Consequently, the starter can be manufactured compactly and efficiently accommodated within the clutch housing of the engine.

However, in this type of starter in which the rotation of the pinion gear is restricted, water which has penetrated into the clutch housing tends to flow into the starter from the open portion of a front case and stays at the lower part of the front case. Consequently, there is a possibility that the connection member connecting the electromagnetic switch and the rotation restriction member with each other makes an unpreferable sliding contact owing to rust caused by the water which has collected in the front case.

SUMMARY OF THE INVENTION

It is accordingly an object of the present invention to provide a starter having a drainage construction capable of smoothly draining water from a front case through a drainage hole and restricting water from entering into the starter from the drainage hole.

According to a starter of the present invention, a communication hole is formed on a partitioning wall of a center case and a projection is formed on the outermost periphery of the communication hole. A holding plate is provided to hold a rotation restriction member for restricting the rotation of a pinion-moving member so that the rotation restriction member is slidable radially. A groove is formed on the spigot-joint fit-in portion of the front case such that the groove extends axially backward along the peripheral side of the circular portion of the holding plate from the front side of the plate portion. A communication port is formed between the holding plate and the center case, thus communicating the groove and a rotation restriction member-holding space with each other. A through-hole is formed in the front case at the position which is not in axial alignment with the communication port, thus communicating with the outside of the front case. The communication hole of the partitioning wall is covered with the holding plate by axially spacing the communication hole at a predetermined interval from the holding plate, and the projection formed on the periphery of the communication hole is fitted in the cut-out of the circular portion of the holding plate. A drainage path constituting a labyrinth construction communicates with the outside of the starter through the groove formed in the fit-in portion of the front case. This construction allows water which has penetrated into the front case to be drained to the outside of the starter from the through hole through the groove. It also allows water which has penetrated into the space positioned between the holding plate and the center case from the inside of the front case to be drained from the through hole to the outside of the starter through the communication port and the groove.

One drainage path of the drainage construction is provided by the groove extending from the front case positioned in front of the holding plate and the through-hole. The other drainage path is provided by the communication port positioned between the groove and the rotation restriction member-holding space positioned between the holding plate and the center case, the groove, and the through-hole. The two drainage paths form a labyrinth construction. That is, the through-hole and the communication port do not align with each other axially. More specifically, the communication port is located in front of the through-hole. Accordingly, when water enters the through-hole from the outside of the starter, it is less likely for the water to penetrate into the starter from the through-hole.

The communication hole communicating the space at the front case side and the space at the starting motor side with each other is formed on the partitioning wall such that the communication hole is covered with the holding plate by axially spacing the communication hole at a predetermined interval from the holding plate. Accordingly, when water which has penetrated into the clutch housing of the engine flows into the front case from an open portion thereof, it is less likely for the water to penetrate into the starting motor through the communication hole.

BRIEF DESCRIPTION OF THE DRAWINGS

Other objects, features and advantages of the invention will become more apparent from the following detailed description when read with reference to the accompanying drawings, in which.

DETAILED DESCRIPTION OF THE PREFERRED EMBODIMENTS

Figure 1:
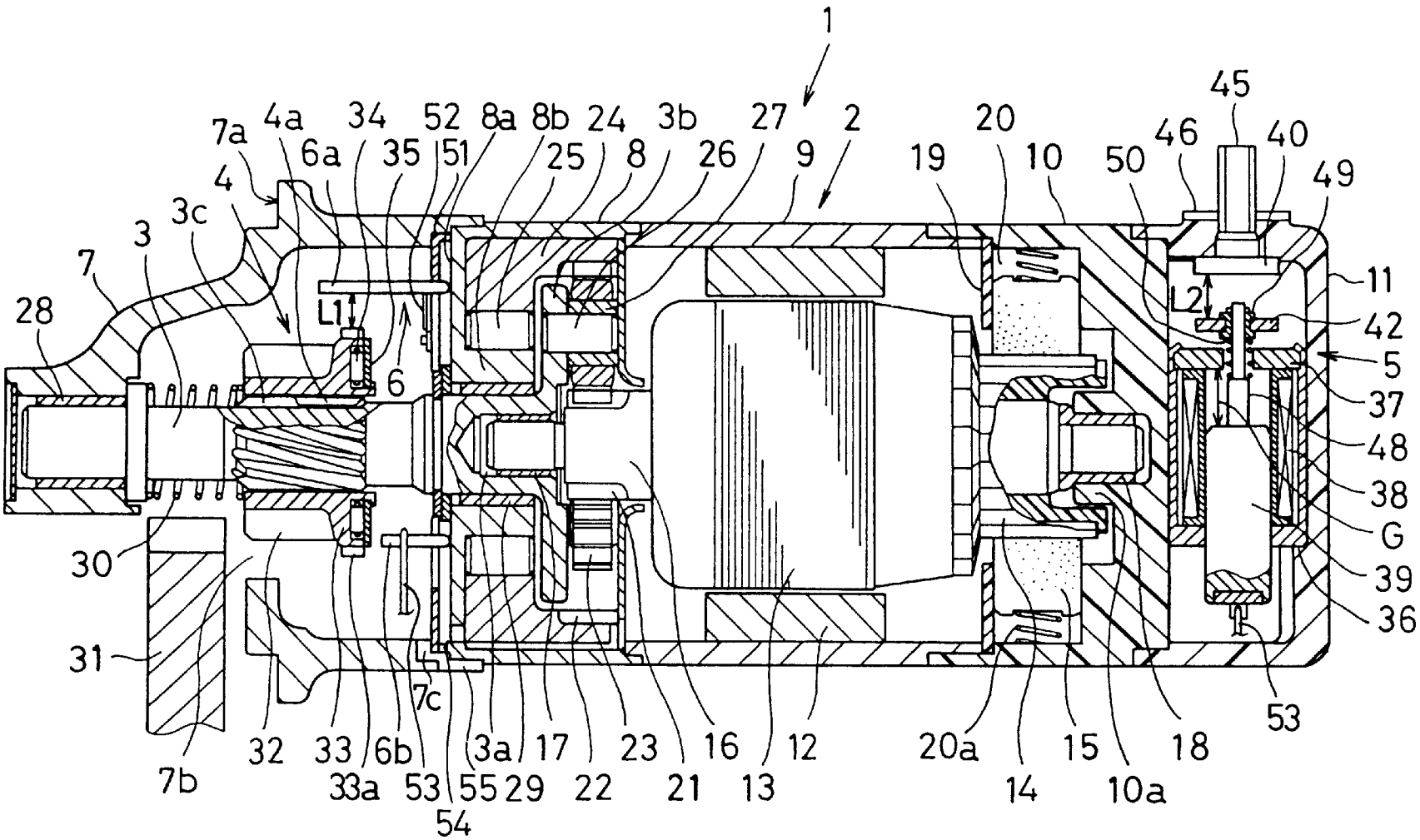
FIG. 1 is a sectional view showing a starter according to an embodiment of the present invention.

A starter according to an embodiment of the present invention will be described below. It is to be noted in FIG.

1 that a starter 1 has two axial end sides, one side which is close to an engine ring gear 31 being referred to as "front side" and the other side opposite to or remote from the ring gear 31 is referred to as "rear side".

The starter 1 generally comprises a cylindrical frame (described later), a starting motor 2 generating a rotational force when energized, an epicycle reduction gear (described later) for reducing the rotational speed of the starting motor 2, an output shaft 3 rotating upon receipt of the rotational force of the starting motor 2 reduced by the epicycle reduction gear, a pinion-moving member 4, the helical spline of which mates with a helical spline formed on the outer periphery of the output shaft 3, an electromagnetic switch 5 controlling the supply of electric current to the starting motor 2, and a rotation restriction member 6 restricting the rotation of the pinion-moving member 4 when the starting motor 2 rotates.

The frame comprises a front case 7, a center case 8, a yoke 9, a brush holder 10, and a rear case 11. These members are fixed by means of through bolts (not shown).

The front case 7 is fixed to a side wall (clutch housing) of an engine (not shown) through an installing surface 7*a*. The center case 8 is interposed between the front case 7 and the yoke 9 and has an integral partitioning wall 8*a* (FIG. 2) partitioning the space at the front case side and the space at the starting motor side from each other.

The starting motor 2 comprises a plurality of fixed magnetic poles 12 (permanent magnets) fixed to the inner peripheral surface of the yoke 9 serving as a magnetic frame, an armature 13 rotatably mounted inside the inner periphery of the fixed magnetic pole 12, and brushes 15 installed on a commutator 14 provided on one axial end of the armature 13.

One end of the yoke 9 fits in the open end of the center case 8 by spigot-joint and the other end thereof fits in the open end of the brush holder 10 by spigot-joint.

One end of a rotation shaft 16 of the armature 13 is inserted into a concave 3*a* formed at the axial rear end of the output shaft 3 so that one end of the rotation shaft 16 is rotatably supported through a bearing 17 fitted in the inner peripheral surface of the concave 3*a*. The other axial end of the rotation shaft 16 is rotatably supported through a bearing 18 held by a bearing portion 10*a* of the brush holder 10.

The commutator 14 is formed of a plurality of commutating segments combined with each other cylindrically on the radially outer periphery of the other end of the rotation shaft 16.

The brushes 15 positioned outwardly from the commutator 14 in the radial direction are accommodated in a brush-accommodating chambers 20 formed of the brush holder 10 and a plate 19 and urged against the outer peripheral surface of the commutator 14 by springs 20*a*. Each brush 15 is held movably in the radial direction (vertically in FIG. 1) in the accommodating chamber 20 and prevented from moving in the rotational direction of the commutator 14.

The epicycle reduction gear comprises a sun gear (external gear) 21 formed at one axial end of the outer periphery of the rotation shaft 16, an internal gear 22 positioned radially outside from the sun gear 21, and a plurality of planetary gears 23 positioned between the sun gear 21 and the internal gear 22 and engaging the sun gear 21 and the internal gear 22.

The internal gear 22 is formed on a gear-constituting member 24 positioned on the inner periphery of the center case 8. A one-way clutch is constructed by a radially inner peripheral part 8*b* of the center case 8 and rollers 25 accommodated between the inner peripheral part 8*b* and the gear-constituting member 24. The one-way clutch allows the gear-constituting member 24 to rotate in the same rotational direction as that of the armature 13 with respect to the center case 8 and nonrotatable in the reverse rotational direction of the armature 13.

Each planetary gear 23 is rotatably supported through a bearing 27 engaging the periphery of a pin 26 pressed into a large-diameter portion 3*b* formed on the periphery of-the output shaft 3 at the rear end thereof.

One end of the output shaft 3 coaxial with the rotation shaft 16 is rotatably supported through a bearing 28 held by the front case 7, and the other end thereof is rotatably supported through a bearing 29 held by the inner peripheral part 8*b* of the center case 8. Thus, the output shaft 3 is prevented from moving axially with respect to the center case 8. A helical spline 3*c* is formed on the output shaft 3 at a portion of the peripheral surface thereof projecting forward (left-hand side in FIG. 1) from the partitioning wall 8*a* of the center case 8.

The pinion-moving member 4 has a helical spline 4*a* formed on its inner periphery. The helical spline 4*a* fits in the helical spline 3*c* of the output shaft 3, thus allowing the pinion-moving member 4 to move along the output shaft 3. A return spring 30 positioned forward from the pinion-moving member 4 urges the pinion-moving member 4 rearward normally. A pinion gear 32 engageable with the ring gear 31 installed on the driving shaft of the engine is formed integrally with the pinion-moving member 4. A collar 33 having an outer diameter larger than that of the pinion gear 32 and having a large number of teeth 33*a* on its outer periphery is formed integrally with the pinion gear 32 at the rear end (right-hand in FIG. 1) thereof. A thrust washer 35 rotatably supported through rollers 34 is installed on the rear end surface of the pinion-moving member 4.

The electromagnetic switch 6 is positioned rearward from the brush holder 10 and accommodated inside the cup-shaped rear case 11. The electromagnetic switch 5 comprises a cylindrical frame 36 having a hole at the center of the bottom thereof, a ground plate 37 fixed to the open end of the frame 36 by caulking, an attraction coil 38 accommodated in the frame 36, a plunger 45 vertically movable along the inner periphery of the attraction coil 38 through a hole of the frame 36. A motor contact (described later) mounted on the electric circuit (FIG. 5) of the starting motor 2 is turned on and off according to the movement of the plunger 39. The frame 36, the ground plate 37, and the plunger 39 are formed of a magnetic material, respectively, thus constituting the magnetic circuit of the electromagnetic switch 5.

Inside the attraction coil 38, the plunger 39 confronts the ground plate 37 through an air gap G. When the attraction coil 38 is energized and magnetic flux is generated in the magnetic circuit, the plunger 39 is attracted toward the ground plate 37, namely, upward in FIG. 1 upon receipt of the magnetic force acting between the ground plate 37 and the plunger 39.

Figure 5:
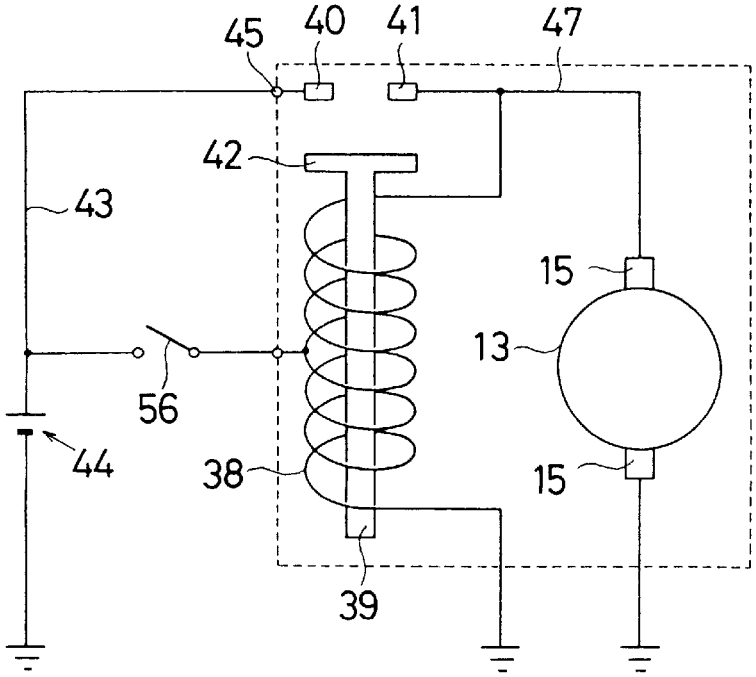
FIG. 5 is an electric wiring diagram showing an electric circuit for a starting motor shown in FIG. 1.

As shown in FIG. 5, the motor contact comprises a battery side fixed contact 40, a motor side fixed contact 41, and a movable contact 42. The battery side fixed contact 40 is integral with a battery terminal 45 connected with a battery 44 through a cable 43 and faces the movable contact 42 inside the rear case 11. A screw on which a nut (not shown) is tightened is formed on the peripheral surface of the battery terminal 45. A washer 46 is fitted on the screw projecting from the rear case 11 to fix the battery terminal 45 to the rear case 11. The motor side fixed contact 41 is electrically connected with the positive polarity brush 15 through a lead wire 47 and faces the movable contact 42 inside the rear case 11.

The movable contact 42 is installed on an upper portion of the rod 48 integral with the plunger 39 through an insulation member 49 and moves together with the plunger 39, thus electrically contacting the fixed contacts 40 and 41 so that the motor contact is turned on. When the movable contact 42 moves away from the fixed contacts 40 and 41, the motor contact is turned off. The movable contact 42 contacts the fixed contacts 40 and 41 at a required biasing force because it is urged by a contact spring 50 through the insulation member 49. The rod 48 mounted at the center of the upper end surface of the plunger 39 extends upward from a through-hole formed at the center of the ground plate 37. The contact spring 50 is positioned on the periphery of the rod 48, with one end of the contact spring 50 fixed to the insulation member 49 and the other end thereof fixed to a stepped surface formed on the periphery of the rod 48.

Figure 2:
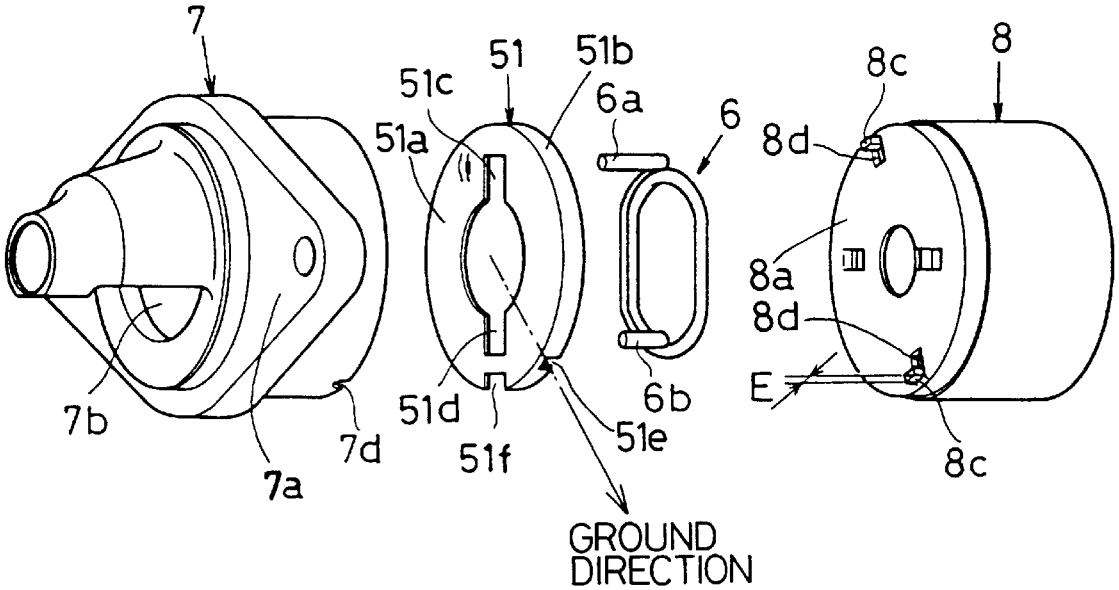
FIG. 2 is a schematic perspective view showing a front case, a holding plate, a rotation restriction member, and a center case of the starter shown in FIG. 1.
Figure 3:
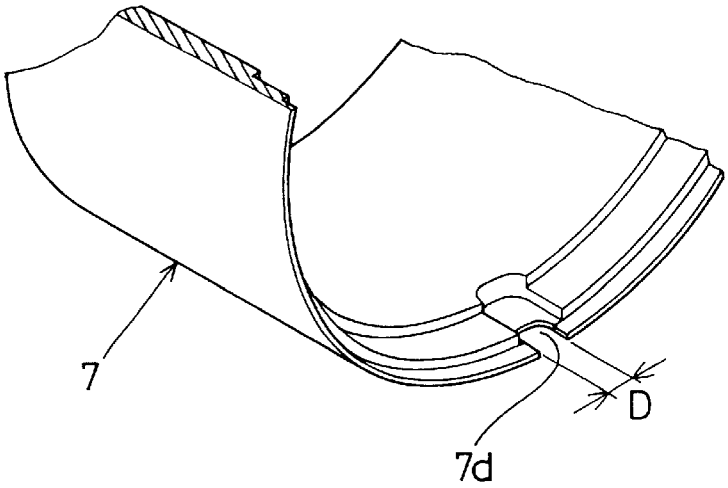
FIG. 3 is an enlarged perspective view showing partly a cut-out portion and a groove of the front case in FIG. 2.

In order to form the rotation restriction member 6, as understood from FIG. 2, a metal rod is coiled, and one end 6*a* and the other end 6*b* thereof are bent approximately perpendicularly to the coiled part thereof to extend one end 6*a* and the other end 6*b* in the same direction. The coiled part of the rotation restriction member 6 is positioned in a flat space formed between the partitioning wall 8*a* of the center case 8 and a plate portion 51*a* of a holding plate 51 positioned in front of the center case 8 so that the entire rotation restriction member 6 is movable substantially vertically in FIG. 1 with respect to the partitioning wall 8*a* and the plate portion 51*a* of the holding plate 51 and constantly urged substantially upward in FIG. 1 by a spring 52 fixed to the plate portion 51*a*. As shown in FIG. 2, the holding plate 51 has a circular portion 51*b* formed on the radially outermost peripheral edge of the plate portion 51*a* and projecting toward the center case 8. The rear end surface of the circular portion 51*b* contacts the partitioning wall 8*a* of the center case 8, thus holding the plate portion 51*a* at a position spaced at a predetermined interval from the partitioning wall 8*a* of the center case 8.

One end 6*a* and the other end 6*b* of the rotation restriction member 6 bent perpendicularly project forward from the plate portion 51*a* through open portions or rectangular holes 51*c* and 51*d* formed thereon. One end 6*a* of the rotation restriction member 6 is positioned radially upward from the output shaft 3 and radially outward from the periphery of the collar 33 of the pinion-moving member 4, whereas the other end 6*b* thereof is positioned radially downward from the output shaft 3 and rearward from the thrust washer 35 of the pinion-moving member 4. The length of one end 6*a* of the rotation restriction member 6 is so set that one end 6*a* is capable of engaging one of the teeth 33*a* of the collar 33 of the pinion-moving member 4 when the rotation restriction member 6 has moved downward in a state in which the pinion-moving member 4 has moved forward a predetermined amount (for example, state in which the end surface of the pinion gear 32 is situated at the position at which it contacts the end surface of the ring gear 31) along the output shaft 3.

When the attraction force (movement of plunger 39) of the electromagnetic switch 5 is transmitted to the rotation restriction member 6 through a connection member 53 (intermediate portion of connection member 53 not shown in FIG. 1) which may be a wire or the like, the rotation restriction member 6 moves downward in FIG. 1 against the urging force of the spring 52. When the magnetic circuit of the electromagnetic switch 5 is turned off, the rotation restriction member 6 is returned to the initial position (position shown in FIG. 1) by the urging force of the spring 52.

One end of the connection member 53 is connected with the other end 6*b* of the rotation restriction member 6, and the other end of the connection member 53 is connected with the bottom of the plunger 39, with intermediate portion of connection member 53 inserted through fixed magnetic poles 12. The connection member 53 is provided with pulleys (not shown) so that the direction of the transmission of the attraction force of the electromagnetic switch 5 can be changed between the vertical and the horizontal directions.

Supposing that the distance between one end 6*a* of the rotation restriction member 6 and the peripheral surface of the collar 33 of the pinion-moving member 4 is L1 and the distance between the movable contact 42 of the electromagnetic switch 5 and both fixed contacts 40 and 41 is L2, the following relationship is set between distances L1 and L2 when the starter 1 is stationary: $L1 \leqq L2$.

Figure 4:
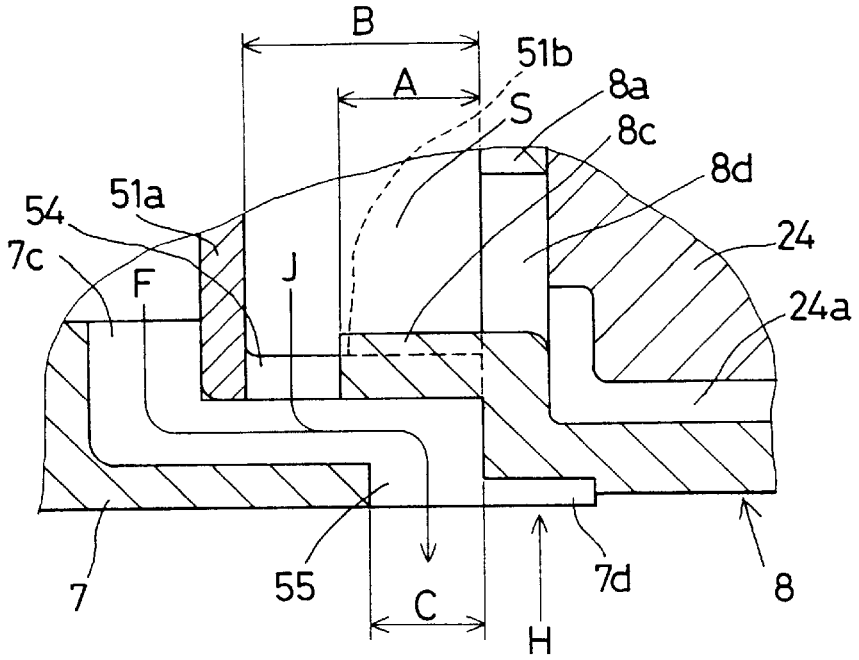
FIG. 4 is a sectional view showing partly a drainage construction provided in the starter shown in FIG. 1.

A drainage construction for draining water which has entered into the front case 7 from an open portion 7*b* thereof is provided for the front case 7, the holding plate 51, and the center case 8. As shown in FIGS. 1 to 4, the drainage construction comprises a groove 7*c* formed on the lower inner peripheral surface of the spigot-joint fit-in portion of the front case 7 which fits in the center case 8 such that the groove 7*c* extends axially backward along a lower part of the holding plate 51 (plate portion 51*a*) from the front side of the holding plate 51, a communication port 54 positioned between the groove 7*c* and a rotation restriction member-holding space S located between the plate portion 51*a* of the holding plate 51 and the partitioning wall 8*a* of the center case 8, thus communicating the groove 7*c* and the rotation restriction member-holding space S with each other, and a drainage through-hole 55 positioned rearward from the communication port 54, thus communicating with the outside of the front case 7 through the groove 7*c*. The communication port 54 is formed by fitting a projection 8*c* formed on the partitioning wall 8*a* of the center case 8 in a cut-out portion 51*e* (FIG. 2) formed on the circular portion 51*b* of the holding plate 51. Therefore, the length A of the projection 8*c* is set to be smaller than the distance B of the cut-out portion 51*e*, as shown in FIG. 4.

In addition to forming the communication port 54, the cut-out portion 51*e* of the holding plate 51 and the projection 8*c* of the center case 8 are used to place the holding plate 51 in position on the center case 8 in the circumferential direction thereof. Thus, the cut-out portion 51*e* and the projection 8*c* are formed on the upper and lower sides of the holding plate 51 and the center case 8, respectively in the radial direction thereof. The cut-out portion 51*e* and the projection 8*c* at the lower side are used to form the communication port 54 of the drainage construction. Because the projection 8*c* is formed on the partitioning wall 8*a* of the center case 8, a communication hole 8*d* communicating the space at the front case side and the space at the starting motor side with each other is formed on the partitioning wall 8*a*. The communication hole 8*d* is covered with the plate portion 51*a* of the holding plate 51 axially by spacing a predetermined interval between communication hole 8*d* and the communication hole 8*d*. The gear-constituting member 24 has a ventilation groove 24*a* formed at a portion of the periphery thereof and communicating with the communication hole 8*d* and the inside of the starting motor 2. The ventilation groove 24*a* forms a ventilation duct communicating the epicycle reduction gear and the inside of the starting motor 2 through the periphery of the sun gear 21.

A slot-shaped cut-out portion 7*d* (FIG. 2) is formed axially at the end surface of the fit-in portion of the front case 7 with which the center case 8 is fitted. The drainage hole 55 is formed on a portion, of the cut-out portion 7*d*, not covered with the center case 8. The length C of the drainage hole 55 in its axial direction is set to be smaller than the height A of the projection 8*c* of the center case 8. The width D (FIG. 3) of the drainage hole 55 (cut-out portion 7*d*) is set to be smaller than the width E (FIG. 2) of the projection 8*c* of the center case 8.

When the starter 1 is mounted on the engine, the cut-out 51 is positioned at the bottom of the starter 1 to face the ground.

As described above, through one drainage path F (FIG. 4) of the drainage construction of this embodiment, water is drained from the drainage hole 55 to the outside of the starter 1 through the front case 7 positioned in front of the holding plate 51 and the groove 7*c*. Further, through the other drainage path J (FIG. 4) of the drainage construction of this embodiment, water is drained from the drainage hole 55 to the outside of the starter 1 from the rotation restriction member-holding space S positioned between the plate portion 51*a* of the holding plate 51 and the partitioning wall 8*a* of the center case 8, the communication port 54, and the groove 7*c*.

In operation, when the key switch 56 (FIG. 5) is turned on, electric current flows from the battery 44 to the attraction coil 38 of the electromagnetic switch 5 to generate a magnetic force which is applied to the plunger 39. Consequently, the plunger 39 is moved upward in FIG. 1, with the result that the other end 6*b* of the rotation restriction member 6 is pulled downward through the connection member 53 and hence the rotation restriction member 6 moves downward, with the spring 52 being deflected. Consequently, one end 6*a* of the rotation restriction member 6 engages the tooth 33*a* of the collar 33 of the pinion-moving member 4, thus restricting the rotation of the pinion-moving member 4.

As a result of the movement of the plunger 39, the movable contact 42 makes a contact with the fixed contacts 40 and 41, thus turning on the motor contact. As a result, electric current flows through the armature 13, and the armature 13 starts rotation. When the motor contact is turned on, the rotation of the pinion-moving member 4 is restricted. The rotation speed of the armature 13 reduced by the epicycle reduction gear is transmitted to the output shaft 3. As a result, the output shaft 3 rotates. At this time, because the rotation of the pinion-moving member 4 is restricted, the rotation of the output shaft 3 is applied to the pinion-moving member 4 as a thrust through the helical spline 3*c* thereof. Consequently, the pinion-moving member 4 moves forward axially along the output shaft 3, and the pinion gear 32 engages the ring gear 31. As a result, the rotation of the armature 13 is transmitted to the ring gear 31 through the pinion gear 32. Consequently, the engine starts.

When the pinion gear 32 engages the ring gear 31, one end 6*a* of the rotation restriction member 6 disengages from the tooth 33*a* of the collar 33 and is located behind the thrust washer 35, thus preventing the pinion-moving member 4 from moving rearward.

When the key switch 56 is turned off after the engine starts successfully, electric current does not flow through the attraction coil 38. As a result, no magnetic force acts on the plunger 39. Thus, the rotation restriction member 6 is moved upward in FIG. 1 and returned to the initial position by the urging force of the spring 52. Consequently, one end 6*a* of the rotation restriction member 6 disengages from the washer 35 of the pinion-moving member 4, thus allowing the pinion-moving member 4 to move rearward. As a result, the pinion-moving member 4 moves rearward along the output shaft 3 and the pinion gear 32 disengages from the ring gear 31.

With the upward movement of the rotation restriction member 6, the plunger 39 is pulled downward through the connection member 53. As a result, the movable contact 42 moves away from the fixed contacts 40 and 41, thus turning off the motor contact. Accordingly, the armature 13 is not supplied with electric current and hence the rotation thereof stops.

As shown by the arrow F in FIG. 4, water which has penetrated into the front case 7 from the open portion 7*b* thereof is drained to the outside of the starter 1 from the drainage hole 55 through the groove 7*c*. As shown by the arrow J in FIG. 3, water which has penetrated from the inside of the front case 7 into the space S positioned between the plate portion 51*a* of the holding plate 51 and the partitioning wall 8*a* of the center case 8 is drained to the outside of the starter 1 from the drainage hole 55 through the communication port 54 and the groove 7*c*.

One drainage path shown by the arrow F in FIG. 4 of the drainage construction is provided by the groove 7*c* extending from the front case 7 positioned in front of the holding plate 51 and the drainage hole 55. The other drainage path shown by the arrow J in FIG. 4 is provided by the communication port 54 positioned between the groove 7*c* and the rotation restriction member-holding space S located between the plate portion 51*a* of the holding plate 51 and the partitioning wall 8*a* of the center case 8, the groove 7*c*, and the drainage hole 55. Each drainage path thus constitutes a labyrinth construction. Accordingly, as shown by an arrow H in FIG. 3, even when water on the ground splashes and tends to enter into the drainage hole 55 from the outside of the starter 1 in the radial direction thereof, it is less likely that the water penetrates into the starter 1 from the drainage hole 55. Thus, the rotation restriction member 6 can be prevented from making a water penetration-caused unpreferable sliding contact movement.

Though, in the above embodiment, the communication port 54 is formed by fitting the projection 8*c* in the cut-out portion 51*e*, it is possible to form the communication port 54 on the circular portion 51*b* of the holding plate 51. In this modification, it is unnecessary to form the projection 8*c* on the center case 8.

Though the slot-shaped cut-out portion 7*d* is formed axially at the end surface of the fit-in portion of the front case 7 to form the drainage hole 55 on a portion, of the cut-out portion 7*d*, not covered with the center case 8, it is also possible to form the drainage hole 55 directly on the fit-in portion of the front case 7.

What is claimed is:

1. A starter for an engine comprising:

a front case attachable to the engine;

a starting motor for generating a rotational force;

a center case interposed between the front case and the starting motor, fitted in a fit-in portion of the front case, and having a partitioning wall substantially partitioning a space in the front case and a space in the starting motor from each other;

an output shaft rotatably supported by the front case and the center case to be driven by the starting motor;

a pinion-moving member having a pinion gear whose spline mates with a helical spline of the output shaft;

an electromagnetic switch positioned at the rear of the starting motor in an axial direction thereof and turning on and off a motor contact installed in an electric circuit of the starting motor;

a rotation restriction member operating when an attraction force of the electromagnetic switch is transmitted thereto through a connection member and restricting a rotation of the pinion-moving member;

a holding plate having a plate portion holding the rotation restriction member radially slidably between the partitioning wall of the center case and the plate portion, and a circular portion formed on a radially outer periphery of the plate portion and holding the plate portion at a predetermined interval spaced from the partitioning wall;

wherein the partitioning wall has a communication hole communicating the space in the front case and the space in the starting motor with each other, and a projection formed at a position near the communication hole;

the holding plate is positioned such that the plate portion covers the communication hole at a predetermined interval spaced axially from the holding plate, and the circular portion has a cut-out mating with the projection of the partitioning plate;

a groove is formed at a fit-in portion of the front case such that the groove extends axially along a peripheral side of the plate portion from a front side of the plate portion;

a communication port communicating a rotation restriction member-holding space and the groove with each other is formed at a fit-in portion at which the projection of the partitioning wall fits in the cut-out of the circular portion; and a through-hole extending from the groove to an outside of the front case is formed in the front case at a position thereof not axially aligning with the communication port.

2. A starter for an engine comprising:

a starting motor for generating a rotational force when energized;

an output shaft operatively coupled with the starting motor to be driven by the starting motor;

a pinion-moving member mounted movably on the output shaft and engageable with an engine ring gear;

a front case disposed axially closely to the starting motor and housing the output shaft and the pinion moving member therein, the front case having a groove extending axially on an inner surface thereof toward the starting motor and a drainage hole provided radially at a position near the starting motor for communicating the groove to an outside thereof;

a plate-like member disposed in the front case at a position radially inside the groove of the front case so that a first communication path between an inside of the center case and the outside of the center case through the groove and the drainage hole is bent at a radially outer periphery of the plate-like member; and a projection extending axially from the starting motor and disposed radially inside of the groove at a position of the drainage hole so that a second communication path between an inside of the starting motor and the outside through the groove and the drainage hole is bent thereby.

3. The starter according to claim 2, wherein the plate-like member is disposed closely to the projection to provide the second communication path therebetween.

4. The starter according to claim 2, wherein an axial length of the projection is longer than that of the drainage hole.

5. The starter according to claim 2, further comprising:

a speed reduction mechanism operatively coupling the starting motor and the output shaft; and a center case disposed between the front case and the starting motor and housing the speed reduction mechanism therein, wherein the projection is formed integrally on the center case.

6. The starter according to claim 5, further comprising:

a rotation restriction member disposed between the plate-like member and the center case and held radially movably to restrict and allow rotation of the pinion-moving member, wherein the plate-like member has an integral wall part extending circumferentially and axially toward the center case at a radially outer part thereof so that the rotation restricting member is housed therein.

7. The starter according to claim 6, wherein the integral wall has a cut-out extending axially and receiving therein the projection of the center case, and the cut-out has an axial length longer than that of the projection to provide the second communication path.

8. The starter according to claim 7, wherein the projection extends from a position radially inside of a radially outer surface of the center case.

* * * * *